United States Patent [19]

Lopez

[11] 4,038,900

[45] Aug. 2, 1977

[54] EXPLOSIVE CLOSURE VALVE

[75] Inventor: Alvaro G. Lopez, Ridgecrest, Calif.

[73] Assignee: The United States of America as represented by the Secretary of the Navy, Washington, D.C.

[21] Appl. No.: 706,869

[22] Filed: July 19, 1976

[51] Int. Cl.[2] ..... F42C 19/02

[52] U.S. Cl. ..... 89/1 B; 102/27 R; 102/70 R

[58] Field of Search ..... 102/70 R, 27 R, 34.4, 102/35.6, 37.6, 6, 39, 65, 66, 85, 90; 89/1 B; 137/68 A

[56] References Cited

U.S. PATENT DOCUMENTS

| | | | |
|---|---|---|---|
| 2,794,396 | 6/1957 | Smith | 102/70 R |
| 3,332,432 | 7/1967 | Marsh | 89/1 B |
| 3,713,392 | 1/1973 | Parsons | 102/70 R |
| 3,789,764 | 2/1974 | Stresau et al. | 102/70 R |

*Primary Examiner*—Charles T. Jordan

*Attorney, Agent, or Firm*—R. S. Sciascia; Roy Miller

[57] ABSTRACT

An explosive closure valve that provides a fast acting seal at an explosive interface. The valve is attached to an interface wall. It operates such that a piston in the valve moves at right angles to the path of a detonating explosive element thereby, positively blocking the hole left by the expended explosive element.

2 Claims, 2 Drawing Figures

EXPLOSIVE CLOSURE VALVE

BACKGROUND OF THE INVENTION

1. Field of the Invention

The present invention is intended for use with a fuel-air explosive system. The system is delivered to the target by conventional means, air dropped, ground launch, or hand emplaced. In such applications, a volatile fuel-air cloud is formed and then a grenade-like device is used to detonate the cloud. The grenade-like device is contained in a chamber which is pressurized to expel the device. The present device provides a seal such that explosive backfires from the chamber are prevented and cloud formation without burning can be accomplished.

The explosive closure valve operates such that the moving energy for the piston is the same explosive element that would normally be employed to initiate the system sequences.

When the explosive element, which passes through the wall, detonates the explosive closure valve simultaneously seals the opening in the wall left by the expended explosive element. The sealing is accomplished by moving a piston at right angles to the opening left by the expended explosive element.

2. DESCRIPTION OF THE PRIOR ART

A particular prior art device intended to accomplish a similar purpose is disclosed in U.S. Pat. No. 3,789,764 to Richard Streshau et al. In Streshau et al., deformation of the so called "insert" is required. The deformation requirement results in a need for control of metal hardness and attendant manufacturing tolerances.

SUMMARY OF THE INVENTION

The invention as disclosed comprises a pressure chamber, ejection explosive, valve housing, piston in the valve housing, and an input explosive element, namely mild detonating fuze, passing through the valve housing. Upon ignition of the mild detonating fuze, the ejection explosive is caused to explode. Simultaneously, the mild detonating fuze drives the piston in the valve housing laterally with respect to the path of the opening left by the expended mild detonating fuze. Thereby, effectively sealing the opening.

DESCRIPTION OF THE PREFERRED EMBODIMENT

Figure 1:
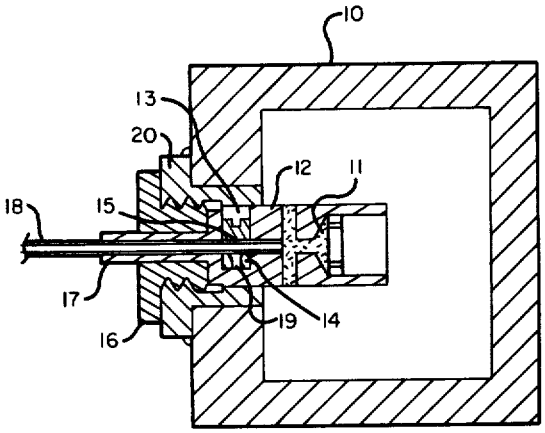
FIG. 1 is a cross section through an assembly illustrating the explosive closure valve in the ready configuration.

FIG. 1 illustrates the explosive closure valve in the ready configuration wherein a pressure chamber 10 formed of a suitable material such as metal encloses an ejection explosive 11 contained therein. The ejection explosive is contained in a valve housing 12 which has a cylinder-like cavity 13 formed at a right angle to the main axis of the valve housing. Contained within the cylindrical cavity 13 is a piston like member 14 which has passageway 15 at a right angle to the movement of the piston like member. The piston 14 also contains bleed hole 19 which intersects passageway 15 at a right angle and extends opposite the direction of piston movement.

The valve housing 12 also has a central passageway completely therethrough as at 17 and contained within passageway 17 of the valve housing and passageway 15 of the piston is the input explosive 18 which in the present embodiment is a mild detonating fuze.

The valve housing 12 is held in position by a securing nut 16 which is threadly inserted into female member 20. The female member 20 is secured to the pressure chamber at the exterior surface of the chamber as by welding. The female member 20 is threaded interiorly and has a central hollowed portion extending therethrough. The valve housing 12 is mounted within the central portion of the female member 20 and secured therein by the securing nut 16.

Figure 2:
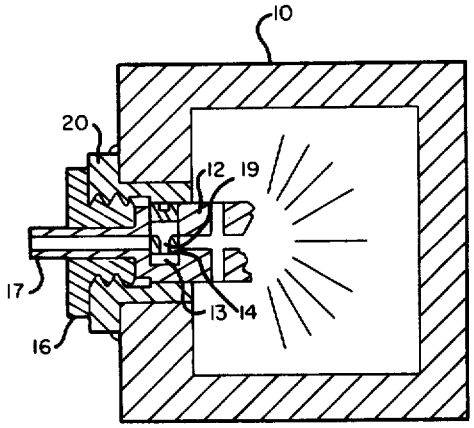
FIG. 2 is a cross section through the assembly illustrating the explosive closure valve in the fired position.

In the operation of the device, the mild detonating fuze 18 is ignited which causes the ejection explosive 11 to detonate. Simultaneously therewith, piston 14 is driven upwardly in cylindrical cavity 13 in FIG. 2. The force with which the piston is driven causes it to swage against the chamber wall where it is locked in place.

It is to be understood that while this is the present locking technique, other conventional means of locking i.e. ball detent, could be employed.

The explosive closure valve requires only that the piston move from the "open" to the "closed" position. No deformation requirement is necessary.

I claim:

1. In an explosive device including an explosive charge in a pressure chamber and a detonating fuse for detonating said charge in communication with the exterior of said chamber, the improvement comprising:

an explosive valve in the path of said detonating fuse for preventing backfire from said chamber when said explosive charge is detonated;

said explosive valve comprising;

valve housing means in the wall of the chamber;

said valve housing means having a cylinder-like portion formed therein;

a piston-like valve means mounted in said cylinder like portion;

a passageway formed in said valve housing means and said piston-like valve means such that in an unfired condition the passageway is in communication with the interior and exterior of the explosive chamber;

detonating fuse means in said passageway adapted to detonate the explosive charge;

the relationship of said piston-like valve means to said valve housing means being such that when said detonating fuse is detonated the passageways through said piston-like valve means and said valve housing means are off-set laterally sufficiently to effectively seal the chamber.

2. In an explosive device as set forth in claim 1 wherein;

said piston-like valve means mounted in said cylinder-like portion moves at right angles to said passageway upon detonation of the detonating fuse means.

* * * * *